United States Patent [19]

Shimek et al.

[11] 4,424,792

[45] Jan. 10, 1984

[54] INDUCED DRAFT SYSTEM FOR RESIDENTIAL HEATERS

[76] Inventors: Ronald J. Shimek, 8996 W. 154th St., Prior Lake, Minn. 55372; Daniel C. Shimek, 2090 Fairmount Ave., St. Paul, Minn. 55105

[21] Appl. No.: 362,529

[22] Filed: Mar. 29, 1982

[51] Int. Cl.[3] ..... F24C 1/14; F24J 11/00

[52] U.S. Cl. ..... 126/80; 126/312; 110/162; 98/48

[58] Field of Search ..... 126/110 C, 110 E, 116 A, 126/293, 312, 301, 80; 110/162, 160; 98/48, 45, 46; 165/DIG. 2, DIG. 12; 432/222

[56] References Cited

U.S. PATENT DOCUMENTS

| | | | |
|---|---|---|---|
| 1,767,869 | 6/1930 | Baumgarten | 110/162 X |
| 3,570,423 | 3/1971 | Hemmingson | 110/160 |
| 3,782,303 | 1/1974 | Pfister et al. | 126/312 X |
| 4,194,488 | 3/1980 | Bellaff | 110/160 X |
| 4,344,370 | 8/1982 | Smith et al. | 110/162 |

*Primary Examiner*—Samuel Scott
*Assistant Examiner*—Randall L. Green
*Attorney, Agent, or Firm*—John B. Sowell

[57] ABSTRACT

A heater without a chimney is installed inside of a residence. An induced draft system is installed outside of the residence. The heater exhaust gases are connected to the induced draft system with an insulated through the wall exhaust pipe which is cooled by mixing cool outside air with the exhaust gases as they are exhausted to the atmosphere.

13 Claims, 5 Drawing Figures

INDUCED DRAFT SYSTEM FOR RESIDENTIAL HEATERS

BACKGROUND OF THE INVENTION

1. Field of the Invention

The present invention relates to an induced draft system for fireplaces and stand alone heaters and more particularly relates to an induced draft system for eliminating chimneys.

2. Description of the Prior Art

The purpose of the present invention is to provide a system for eliminating a conventional masonry or prefabricated metal chimney. Masonry chimneys are usually made of two walls and an inner tile liner that rises above the highest point on the roof of a house. Even when a masonry chimney is made on an original house it is an expensive item. Masonry chimneys are more expensive when added to a house which is already made. To overcome the high cost of masonry chimneys, prefabricated metal chimneys have been designed. Such prefabricated metal chimneys are often used with new housing construction when constructed on the outside to reduce the cost of a conventional masonry chimney. When such prefabricated metal chimneys are installed through the ceiling and eventually through the roof in the interior of a house there arises several problems requiring cutting through both the ceiling and the roof and then providing special flanges and adapters and flashing in order to seal leaks. When such prefabricated metal chimneys are built into an interior room of a house the clearance between the flammable ceiling and roof structure becomes critical because the metal chimneys are often operated above the kindling temperature of the adjacent structures.

Conventional chimneys whether made from masonry or prefabricated metal pipes have a problem with draft because it is dependent not only upon the height of the chimney above the heater but the temperature in the heater, the outside air temperature, the barometric pressure conditions, as well as environmental conditions.

Conventional chimneys when constructed outside of a house form a cooling tower which rapidly cools the hot gases leaving a heater inside of the house. Rapidly cooling of unburned gases is known to cause deposits of creasote in conventional chimneys which creates a well recognized fire hazard.

It would be extremely desirable to provide some means for eliminating the problems associated with conventional chimneys. It would be desirable that the system be economical and easy to install while providing greater burning efficiency and fire safety.

SUMMARY OF THE INVENTION

The primary object of the present invention is to provide a system for eliminating a conventional chimney of the type currently used with any fuel type heater.

It is another principal object of the present invention to provide an induced draft system for any type residential heater which comprises means for adjusting, controlling and optimizing the draft requirements for the residential heater.

It is another object of the present invention to provide an induced draft system which obtains greater burning efficiency from residential heaters.

It is another object of the present invention to provide an induced draft system for cooling and removing hot exhaust gases immediately after leaving the heater so as to minimize fire hazards.

It is yet another object of the present invention to provide an induced draft system for mixing cool fresh air with the hot exhaust gases to reduce the concentration of unburned hot gases.

It is yet another object of the present invention to provide an induced draft system that produces rapid movement of the mixed hot gases and fresh cool air to prevent creosote buildup in the induced draft system.

It is another object of the present invention to provide novel control means which sense a power failure of the primary induced draft fan motor drive and automatically turns on a standby drive motor system.

It is another object of the present invention to provide an induced draft system for exhausting hot gases from a residential heater at a much lower temperature than prefabricated metal chimneys.

It is another general object of the present invention to provide control means for sensing the condition of the induced draft system and providing automatic protection against fire hazards.

It is yet another object of the present invention to provide an induced draft system capable of producing a draft which enhances use of a catalytic converter and/or a heat exchanger while maintaining sufficient draft in the heater to operate the heater at optimum burning efficiency.

It is another general object of the present invention to provide means for completely eliminating down draft when a fire in a heater is dying out or smoldering.

In accordance with these and other objects of the present invention there is provided a housing having an induced draft fan therein adapted to be installed on an outside wall of a house. An insulated exhaust pipe is connected through the wall connecting the housing to a residential heater inside of the house. An intake pipe in the housing is extended from a source of fresh cool air into the center portion of the insulated exhaust pipe to a point inside the wall so as to provide mixing of the hot exhaust gas from the heater with the cool fresh air in the insulated exhaust pipe before it is exhausted by the induced draft fan.

DESCRIPTION OF THE PREFERRED EMBODIMENT

Figure 1:
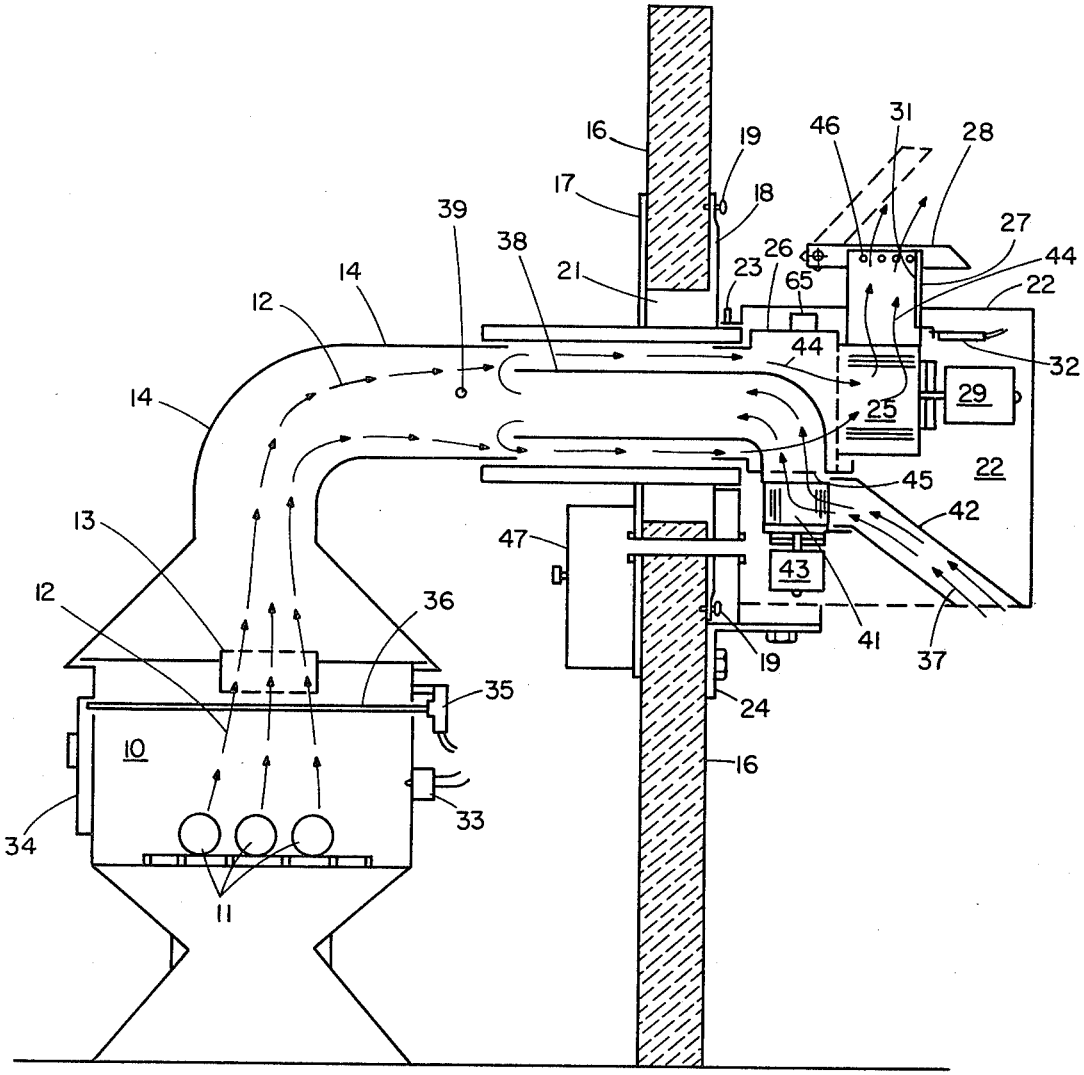
FIG. 1 is a schematic sectional elevation of a stand alone heater connected to the present invention induced draft system.

Refer now to FIG. 1 showing in sectional elevation a preferred embodiment stand alone heater connected to the present invention induced draft system. The stand alone heater 10 is shown having burning logs 11 which produce hot gases 12 which pass through a catalytic converter 13 and enter into the exhaust stack 14 where they are conducted to the intake of the insulated exhaust pipe 15. Such insulating exhaust pipes are preferably two concentric cylinders of stainless steel separated by asbestos. The insulated exhaust stack passes through the exterior wall 16 of the building in which the space heater 10 is placed. Wall 16 is an exterior wall. An inner decorative collar 17 is attached to the interior side of the wall and tightly supports the insulated exhaust pipe 15. An outer wall spacer 18 is attached to the outside of wall 16 by screws 19 and is also snugly fitted against the outside of insulated exhaust pipe 15. The space between inner collar 17 and outer wall spacer 18 is preferably filled with an insulating air void 21. Housing 22 connects to the insulated exhaust pipe 15 and is held in place by set screws 23 and is supported by a support bracket 24 which bolts to the wall 16 and to housing 22. p An induced draft fan 25 is mounted inside of housing 22 and is provided with an intake duct 26 which connects to the insulated exhaust pipe 15. An exhaust duct 27 connects to the induced draft fan 25 and is provided with a pivotal cap 28 which opens when exhaust gases are flowing through the exhaust duct 27 as shown by the phantom lines. Electric drive motor 29 is preferably an alternating current motor having a speed control device capable of providing a wide range of variable speeds. When the electric drive motor 29 induces the flow of air and gas through the fan 25 causing the pivotal cap 28 to move upward, a linkage 31 actuates micro switch 32 opening its normally closed contacts. Micro switch 32 is connected in series with thermal switch 33 mounted on the outside of heater 10. Thermal switch 33 is normally open when cool and normally closed when hot as will be explained hereinafter with reference to the wiring diagrams. The door 34 on heater 10 maintains a second micro switch 35 normally closed when door 34 is closed by means of actuating rod 36.

In the preferred mode of operation motor 29 is normally inducing a draft in intake duct 26 which connects to insulated exhaust pipe 15. The hot gases 12 attempt to enter the space at the entrance of exhaust pipe 15 and are mixed with fresh outside cool air 37 which passes through intake pipe 38 and mixes at region 39 before passing along the outside of intake pipe 38 and passing into intake duct 26 where it is pulled through the fan 25 and passed to the exhaust duct 27 to the outside atmosphere.

In the preferred embodiment shown in FIG. 1 the intake pipe 38 is connected to the intake duct side of standby fan 41 and the plenum or housing of fan 41 connects to the exhaust duct 42 of fan 41. It will be observed that the outside cool fresh air enters through the exhaust duct 42 of fan 41 which is driven by standby motor 43.

In the preferred mode of operation when the heater 10 is burning logs 11 the outside fresh air enters through duct 42 and passes through intake pipe 38 where it is mixed at region 39 with the hot exhaust gases 12 and passes as a mixed gas on the outside of intake pipe 38 and passes through the fan 25 to the outside atmosphere. In the event that there is a failure of the primary electric drive motor 29 it is desirable that the hot exhaust gases 12 be removed by the induced draft system. In order to accomplish this removal of the hot gases 12, standby motor 43 will be actuated by a battery system as will be explained hereinafter and will pull the mixed gases into the fan 41 at the intake 45 and pass the mixed gases out through exhaust duct 42. Thus, it will be observed that the outside cool fresh air will be provided through exhaust duct 27 and intake duct 26 of fan 25. It will be noted that bleed apertures 46 are provided in exhaust duct 27 to assure that fresh air is capable of entering into the system during standby motor operation. Control box 47 attached to wall 16 houses the electrical control circuitry which will be explained hereinafter.

Figure 2:
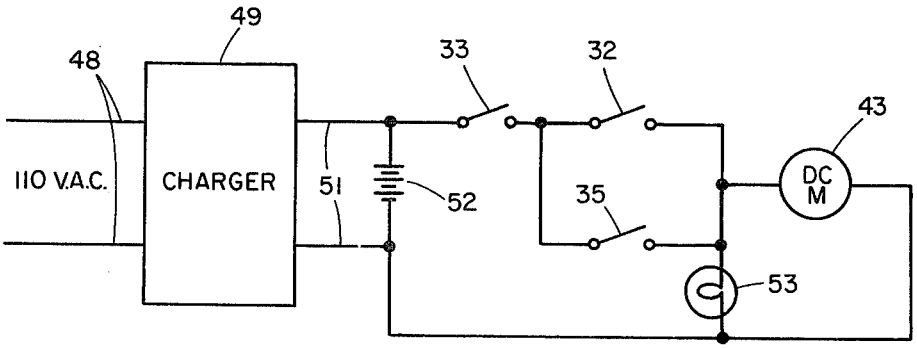
FIG. 2 is a detailed schematic wiring diagram of a preferred embodiment control for the standby motor of the induced draft system of FIG. 1.

Refer now to FIG. 2 showing a wiring diagram circuit for the standby motor 43. A 110 volt AC source is shown at lines 48 which connects to charger 49. Charger 49 supplies a 6.9 volt DC voltage which is applied in parallel to the six volt battery 52. When thermal switch 33 is closed representing a high temperature at heater 10 the voltage from charger 49 or battery 52 is available at micro switch 32 and at micro switch 35. When either micro switch 32 or 35 or both are closed, the DC motor 43 is energized and the indicator light 53 is turned on. There are two occasions when it is desirable that the standby motor 43 be actuated. In both occasions the heater is indicated to be hot thus requiring some exhaust system. When the micro switch 32 is closed indicating that the primary electric drive motor 29 is no longer working it is desirable that the standby motor 43 come on and take the hot gases 12 to the outside atmosphere. Similarly, when the door 34 of heater 10 is opened and it is indicated that there is a fire in the heater 10 then micro switch 35 is closed and the DC motor 43 comes on as an auxiliary motor increasing the draft and discharge of the hot gases 12 to the outside atmosphere.

Figure 3:
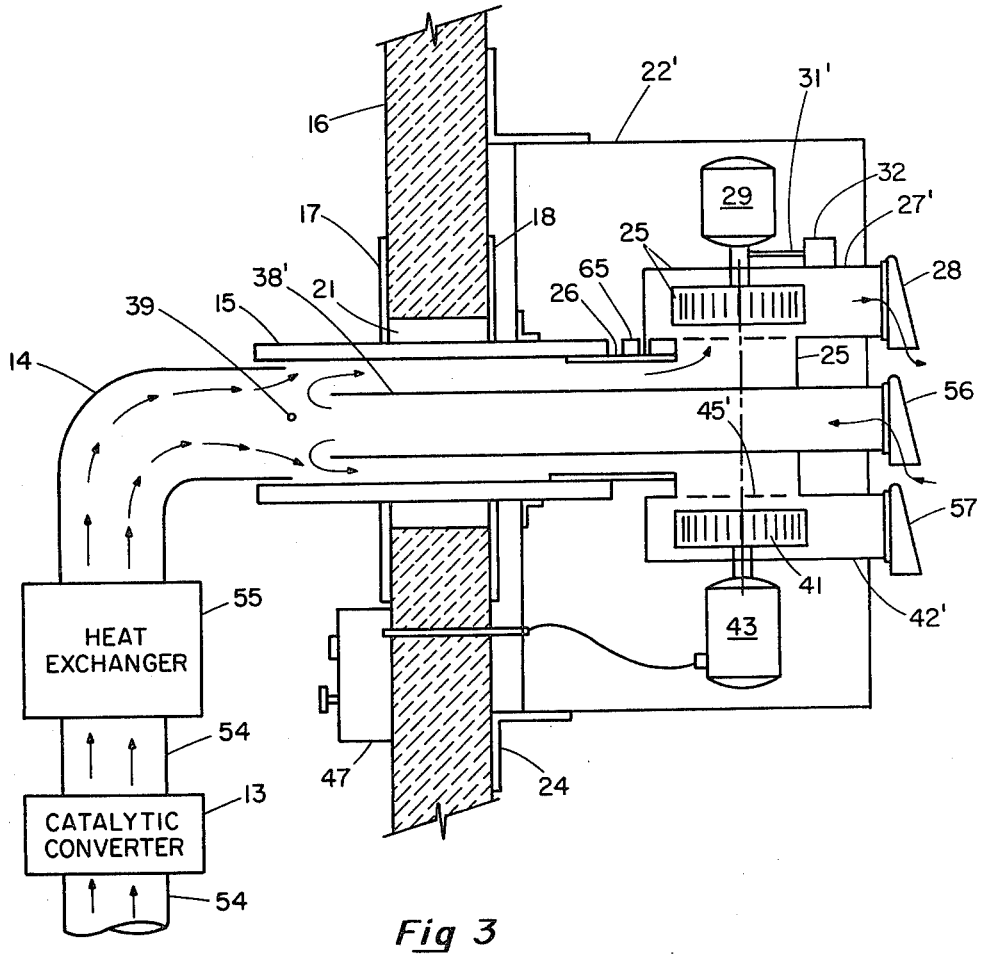
FIG. 3 is a schematic sectional elevation of a modified form of an induced draft system.

Refer now to FIG. 3 showing a slightly modified form of induced draft system. An exhaust pipe 54 is adapted to be connected to one of the different forms of heaters 10 which are usable with the present system. The exhaust pipe 54 is shown having a catalytic converter 13 connected in the exhaust pipe system. The exhaust gases are more throughly burned by catalytic converter 13 thus raising the temperature in exhaust pipe 54 and this provides additional heat which may be extracted by heat exchanger 55 before being passed on to the standard or previously described exhaust stack 14. Exhaust stack 14 is again connected to the insulated exhaust pipe 15 which passes through wall 16 and is connected to the intake duct 26 of induced draft fan 25 driven by motor 29. The exhaust duct 27′ is passed through the outer wall of housing 22′ is provided with a pivotal cap 28′. The micro switch 32 is actuated by an actuating rod or linkage 31′ which senses whether motor 29 is rotating. Such means may comprise a well known centrifugal switch. The intake pipe 38′ extends from the housing 22′ through the wall 16 and into the mixing region 39 where hot exhaust gases in exhaust stack 14 are mixed and passed around the outside of intake pipe 38′ to the intake duct 26 of induced draft fan 25 which passes the mixed hot gases and cool fresh air to the outside atmosphere. The cool fresh air is shown entering a shroud 56 and passing into the interior of intake pipe 38′.

In the FIG. 3 embodiment when the standby motor 43 is not operating and the primary electric drive motor 29 is operating, it is possible to induce the flow of cool fresh air through the shroud 57 and the exhaust duct 42 of standby fan 41. Air flowing through fan 41 will pass through the intake 45′ and into the insulated exhaust pipe 15.

When primary electric drive motor 29 is disabled the micro switch 32 is closed and stand by motor 43 is activated as will be explained hereinafter with reference to the wiring diagrams. Having explained the operation of FIG. 1 in detail it will now be understood that when stand by motor 43 is actuated and primary electric drive motor 29 is deactivated, the flow of fresh cool air enters through pivotal cap 28' and exhaust duct 27' as well as through the shroud 56 and intake pipe 38', and the mixed gases are exhausted through the exhaust duct 42' and shroud 57.

The schematic representation of exhaust pipe 54, catalytic converter 13 and heat exchanger 55 are presented in block diagrammatic form but are preferably located inside of a heater 10. While FIGS. 1 and 3 have been explained with reference to a free standing type heater 10, it will be understood that for purposes of this specification that the word heater shall mean any type of add-on furnace, air tight wood stove, free standing fireplace, zero clearance metal fabricated fireplace or any stove or masonry fireplace which is provided without its own chimney. Such heaters are designed to use wood, coal, gas, oil and other fuels.

Figure 4:
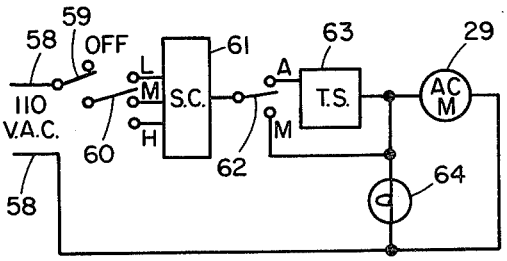
FIG. 4 is a schematic wiring diagram showing a preferred embodiment circuit for start-up and run of the primary electric motor drive.

Refer now to FIG. 4 showing a preferred embodiment wiring diagram for the operation of the AC motor 29 which is the primary electric drive motor. A 110 volt AC supply is provided at the source lines 58 which are connected through manual switch 59 to a variable control 60. Variable control 60 is shown having low, medium and high motor control speed positions and may be any type of well known speed control 61. The output of the speed control 61 is shown as a selector switch 62 adapted to select the automatic or manual positions. When the manual position is selected, as when a fire is being started in the heater 10, it by passes the thermostatic switch so as to energize the primary electric drive motor 29 and turn on the indicator light 64. After the heater 10 reaches a sufficient operating temperature the selector switch 62 may be positioned to the automatic position where it passes through the thermostatic switch 63 which will maintain the drive motor 29 activated so long as the switch 63 is warm or hot.

Figure 5:
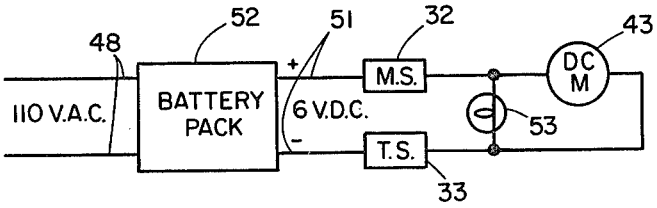
FIG. 5 is a simplied schematic wiring diagram showing the basic operation of the standby motors.

Refer now to FIG. 5 showing a simplified wiring diagram for the operation of the stand by motor 43. The 110 volt AC power source is provided at the input lines 48 which are shown connected to a battery pack 52 which provides a 6 volt DC output on lines 51. In series with the DC motor 43 there is shown the aforementioned micro switch 32 and the temperature control switch 33. When the heater 10 is hot the temperature switch 33 is closed and when the primary electric drive motor 29 is deactivated the micro switch 32 is closed thus activating the DC stand by motor 43 and at the same time activating the indicator light 53.

Figure 6:
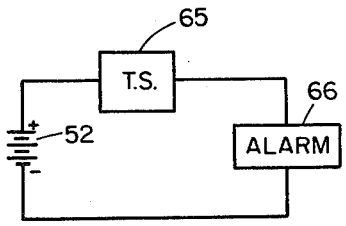
FIG. 6 is a schematic wiring diagram showing a preferred embodiment alarm system.

Refer now to FIG. 6 showing a simplified alarm diagram which may be employed with either the FIG. 1 or FIG. 3 embodiment. A thermal switch 65 is shown mounted on the intake duct 26 of the induced draft fan 25. This thermal switch 65 is normally open and is closed when the temperature in the intake duct 26 exceeds a predetermined value. Closing of thermal switch 65 causes the alarm 66 to be activated by battery 52. The alarm 66 is advantageous to alert the operator of heater 10 that his fire is becoming so hot that the exhaust gases 12 are reaching a point where they would ordinarily be dangerous in a conventional chimney system.

Having explained a preferred embodiment induced draft system and a modified induced draft system it will be understood that the stand by motor 43 is optional in many circumstances. For example, when an airtight stove is connected to either of the induced draft system, the induced draft fan 41 and stand by motor 43 may be dispensed with. An airtight stove will not permit back pressure to force smoke through the stove but will build up pressure and cause the hot gases 12 to move through the induced draft system.

By proper design of the ratio of diameters of the insulated exhaust pipe 15 and the intake pipe 38 the ratio of cool air to hot exhaust gas may be accurately determined. In the preferred embodiment induced draft system shown, a desirable ratio will permit cooling the exhaust gas 12 by a factor of 75 percent. Under such circumstances the typical exhaust combustion gas with a catalytic converter is typically 600° to 800° F. in region 39 and can be reduced to 150° to 200° F. at the exhaust region 27.

When the catalytic converter 13 increases the burning efficiency of the fuel in the heater 10, the temperature in exhaust stack 14 may be approximately 1200° F. and when reduced by a factor of four or 75% the temperature in the mixing region and in the induced draft system drops to approximately 300° F.

Another feature of the present invention is concerned with the reduction of creosote build-up when burning wood. The induced draft fan 25 is preferably designed to induce a rapid flow of air and hot gases in the insulated exhaust pipe 15 and at region 39 so that creosote does not build-up. The conditions for the build up to creosote require that there be a high concentration of unburned hydrocarbons and a low air velocity coupled with a cold chimney or a cold stack. None of these conditions exist. In fact, the mixing of the exhaust gas tends to dilute the concentration of any unburned hydrocarbons. When the catalytic converter is employed with the present invention system there are so few hydrocarbons that the tendency of creosote to form is negligible. The rapid movement of the gases through the present invention induced draft system tends to stabilize the temperature throughout the system and does not provide the stagnant air condition effect which is associated with the build-up of creosote.

Having explained a preferred embodiment and a modified embodiment of the present invention it will be understood that the present invention induced draft system is a superior substitute for a chimney in either new building or remodeling of existing residential homes.

We claim:

1. An induced draft system for connection to a heater that is adapted to heat an interior space, comprising:

an insulated exhaust pipe for connection to said heater in said interior space, an induced draft system housing mounted outside said space to be heated, said insulated exhaust pipe being adapted to connect through a wall to connect said heater to said induced draft system housing, an intake pipe mounted in said housing for conducting outside cool fresh air into a central portion of said insulated exhaust pipe, an induced draft fan mounted in said induced draft system housing, said induced draft fan having an exhaust duct connected thereto for conducting hot gas from said heater to the outside of said housing, said induced draft fan having an intake duct connected thereto and connected to said insulated exhaust pipe, and an electric drive motor connected to said induced draft fan for pulling hot gas from said heater into said insulated exhaust pipe and for pulling cool outside fresh air from said intake pipe and for mixing said hot gas in said cool fresh air in said insulated exhaust pipe before exhausting said mixed hot gas and cool fresh air from said exhaust duct.

2. An induced draft system as set forth in claim 1 which further includes control means adapted to activate said electric drive motor, said control means comprising, a manual start switch for activating said electric motor on starting said heater, and an auto-control switch for maintaining said electric motor activated until said heater is cool.

3. An induced draft system as set forth in claim 2 wherein said control means further comprises a first thermostatic switch adapted to be mounted on said heater for deactivating said electric drive motor when said heater is cool.

4. An induced draft system as set forth in claim 3 wherein said control means further includes an indicating light for indicating when said first thermostatic switch is closed and said electric drive motor is running.

5. An induced draft system as set forth in claim 2 which further includes, an on-off switch mounted in said induced draft fan housing and adapted to sense when said electric drive motor is not running and for energizing a standby motor.

6. An induced draft system as set forth in claim 1 which further includes an alarm circuit, said alarm circuit comprising a battery and a buzzer in series with a normally open thermostatic switch mounted on said housing in the path of said cool fresh air for energizing said buzzer when said therostatic switch is heated.

7. An induced draft system as set forth in claim 1 which further includes, a standby motor, a rechargeable battery pack connected to said standby motor, a thermostatic switch adapted to be mounted on said heater for activating said standby motor when said heater is warm, and an off-on switch in series with said thermostatic switch and forming a closed electric path when said electric drive motor is not running.

8. An induced draft system as set forth in claim 1 wherein said intake pipe extends into said insulated exhaust pipe far enough to cause mixing of said hot gas with said cool fresh air before said hot gas from said heater reaches the wall, whereby, said insulated exhaust pipe is maintained cooled at the portion mounted through said wall,

9. An induced draft system as set forth in claim 8 wherein the ratio of the intake pipe size to the exhaust pipe size is selected to cool said hot gas from said heater by approximately seventy-five percent.

10. An induced draft system as set forth in claim 9 wherein said mixed hot gas and cool fresh air are maintained between 150° F. and 200° F.

11. An induced draft system as set forth in claim 9 wherein the velocity of the mixed hot gas and cool air in said insulated exhaust pipe is maintained above 240 feet per minute to prevent creation of creosote in said exhaust system.

12. An induced draft system as set forth in claim 1 which further includes a catalytic converter in the path of said hot gas leaving said heater for oxydizing the unburned hot gases.

13. An induced draft system as set forth in claim 12 which further includes a heat exchanger in the path of said hot gas leaving said catalytic converter.

* * * * *